US005887809A

United States Patent [19]

Walters

[11] Patent Number: 5,887,809

[45] **Date of Patent: *Mar. 30, 1999**

[54] CLEAR-TRAJECTORY ROTARY-DRIVEN IMPACT COMMINUTER

[75] Inventor: Jerry Wayne Walters, Baton Rouge, La.

[73] Assignee: Wildcat Services Inc., Baton Rouge, La.

[ * ] Notice: The term of this patent shall not extend beyond the expiration date of Pat. No. 5,544,820.

[21] Appl. No.: 827,797

[22] Filed: Apr. 11, 1997

Related U.S. Application Data

[62] Division of Ser. No. 627,766, Apr. 1, 1996, which is a continuation of Ser. No. 392,557, Feb. 21, 1995, Pat. No. 5,544,820.

[51] Int. Cl.[6] ..... B02C 13/282

[52] U.S. Cl. ..... 241/187; 241/275; 241/285.1

[58] Field of Search ..... 241/40, 275, 188.1, 241/194, 260.1, 285.1, 72, 187

[56] References Cited

U.S. PATENT DOCUMENTS

| | | | |
|---|---|---|---|
| 112,059 | 2/1871 | Mallory | 241/187 |
| 246,992 | 9/1881 | Anderson . | |
| 430,646 | 6/1890 | Hickey | 241/187 |
| 455,531 | 7/1891 | Good . | |
| 489,079 | 1/1893 | Kellner . | |
| 1,472,609 | 10/1923 | Martin . | |
| 1,703,211 | 2/1929 | Schmierer | 241/275 |
| 2,188,230 | 1/1940 | Nicholson | 241/187 |
| 2,540,021 | 1/1951 | Wright . | |
| 2,555,879 | 6/1951 | Fogle . | |

(List continued on next page.)

FOREIGN PATENT DOCUMENTS

| | | | |
|---|---|---|---|
| 178143 | 4/1986 | European Pat. Off. . | |
| 1238099 | 6/1960 | France | 241/187 |
| 541014 | 5/1957 | Germany . | |
| 361464 | 4/1962 | Germany . | |
| 1209851 | 1/1966 | Germany . | |
| 1221082 | 7/1966 | Germany | 241/187 |
| 1008093 | 5/1967 | Germany . | |
| 2126076 | 12/1971 | Germany | 241/275 |
| 2244951 | 9/1972 | Germany . | |
| 2738462 | 3/1979 | Germany . | |
| 737007 | 5/1980 | Russian Federation . | |
| 1242233 | 7/1986 | Russian Federation . | |
| 1722570 | 3/1992 | Russian Federation . | |
| 1727898 | 4/1992 | Russian Federation . | |
| 2015729 | 7/1994 | Russian Federation | 241/260.1 |
| 685167 | 12/1952 | United Kingdom | 241/187 |

OTHER PUBLICATIONS

Scott Equipment Company, "Dominator Crusher", Product Literature.

Scott Equipment Company, "Scott ASM Fine Grinder", Product Literature.

Hosokawa Bepex Corporation, "We offer total . . . ", Product Literature.

Franklin Miller, "Solids Reduction Processors", Product Literature.

Buffalo Hammer Mill Corporation, "R Series Dual–Stage Hammer Mill", Product Literature.

Franklin Miller, "Taskmaster", Product Literature.

Modern Process Equipment Inc., "The MPE Gran–u–lizer™", Product Literature.

*Primary Examiner*—Mark Rosenbaum

*Attorney, Agent, or Firm*—Raymond G. Areaux; Lisa Charouel

[57] ABSTRACT

This invention relates to an apparatus for comminuting rock and other material and, in particular, to a rotary driven blade apparatus which comminutes rock, drilling materials and other material by impact rather than by grinding or crushing. More particularly, the invention creates a comminution environment which maximizes the establishment of a clear trajectory for the material between the orbit of each spinning blade and a single breaker bar.

32 Claims, 7 Drawing Sheets

U.S. PATENT DOCUMENTS

| | | | |
|---|---|---|---|
| 2,607,538 | 8/1952 | Larson . | |
| 2,644,644 | 7/1953 | West . | |
| 2,768,938 | 10/1956 | Martin | 241/40 |
| 2,903,192 | 9/1959 | Clausen . | |
| 3,226,045 | 12/1965 | Shelton et al. | 241/188.1 |
| 3,260,468 | 7/1966 | Beard . | |
| 3,428,259 | 2/1969 | Zifferer . | |
| 3,471,093 | 10/1969 | Wienert | 241/194 |
| 3,480,214 | 11/1969 | Wageneder et al. . | |
| 3,608,841 | 9/1971 | Wageneder et al. . | |
| 3,610,544 | 10/1971 | O'Connor . | |
| 3,895,760 | 7/1975 | Snyder . | |
| 3,995,814 | 12/1976 | Alberts . | |
| 4,077,574 | 3/1978 | Francis . | |
| 4,088,528 | 5/1978 | Berger et al. | 241/260.1 |
| 4,090,673 | 5/1978 | Ackers et al. . | |
| 4,093,127 | 6/1978 | Alberts et al. . | |
| 4,151,959 | 5/1979 | Deister . | |
| 4,274,601 | 6/1981 | Musto . | |
| 4,333,278 | 6/1982 | Schulte et al. . | |
| 4,371,117 | 2/1983 | von Bennigsen-Mackiewicz et al. . | |
| 4,373,678 | 2/1983 | Reitter . | |
| 4,373,679 | 2/1983 | Kawano et al. . | |
| 4,619,409 | 10/1986 | Harper et al. | 241/188.1 |
| 4,729,516 | 3/1988 | Williams, Jr. . | |
| 4,733,826 | 3/1988 | Komori et al. . | |
| 4,934,614 | 6/1990 | Lewis . | |
| 5,031,845 | 7/1991 | Gemsjager . | |
| 5,074,477 | 12/1991 | Welter et al. . | |
| 5,161,746 | 11/1992 | Bliss . | |
| 5,184,784 | 2/1993 | Rose et al. . | |
| 5,248,101 | 9/1993 | Rose et al. . | |
| 5,272,861 | 12/1993 | Roynberg . | |
| 5,280,857 | 1/1994 | Reichner . | |
| 5,395,417 | 3/1995 | Thomas . | |
| 5,400,977 | 3/1995 | Hayles | 241/188.1 |
| 5,511,729 | 4/1996 | Husain . | |
| 5,544,820 | 8/1996 | Walters | 241/188.1 |
| 5,562,257 | 10/1996 | Graveman . | |
| 5,577,669 | 11/1996 | Vujnovic . | |

CLEAR-TRAJECTORY ROTARY-DRIVEN IMPACT COMMINUTER

This is a divisional of application Ser. No. 08/627,766, filed on Apr. 1, 1996 which is a continuation of application Ser. No. 08/392,557 filed on Feb. 21, 1995, now U.S. Pat. No. 5,544,820.

This invention relates to an apparatus for comminuting rock and other material and, in particular, to a rotary driven blade apparatus which comminutes rock, drilling materials and other material by impact rather than by grinding or crushing. More particularly, the invention creates a comminution environment which maximizes the establishment of a clear essentially tangential trajectory for the material between the orbit of each spinning blade and a single breaker bar.

BACKGROUND OF THE INVENTION

In many rotary driven comminution devices, comminution is achieved, in whole or in part, by grinding or crushing the material, as described in the following five U.S. Patents.

In U.S. Pat. Nos. 3,480,841 and 3,608,841 by Wageneder, the spatial mounting of the grate and rotor within the housing define a converging orbital clearance into which the material is forced by the rotor and thus crushed between the blades of the rotor and the grate. The Wageneder invention is not designed to maximize lifting and flinging of the material toward a breaker bar. In operation, the rotary grinding and crushing function of the Wageneder apparatus impedes the lifting and centrifugal flinging of material into a clear trajectory as is desired in my invention.

In U.S. Pat. No. 4,373,678 by Reitter, Reitter, like Wageneder, relies on a converging orbital path to crush and grind the material. Again, Reitter's invention is not designed to maximize lifting and flinging of the material at a breaker bar; and, like Wageneder, Reitter's apparatus, in operation, impedes the lifting and flinging of material through its rotary grinding and crushing function.

In U.S. Pat. No. 4,934,614 by Lewis, Lewis, like Reitter and Wageneder, relies on a close orbital path to crush the material. Lewis uses a plurality of breaker bars, rather than a sole breaker bar; and, in particular, Lewis does not teach the advantage, as I have discovered, of using a sole breaker bar in combination with the establishment of a clear-trajectory material path for flinging the material at the sole breaker bar. Lewis teaches away from my discovery by using a second grinding chamber in which the comminutable material pools. Pooling of the material inhibits and impedes the establishment of a clear-trajectory material path as does the use of multiple breaker bars.

In U.S. Pat. No. 4,093,127 by Alberts, et al., Alberts teaches the use of a rotary driven means arranged to maximize particle-to-particle impact and to minimize impact of the particles with the structure of the machine. Thus, Alberts teaches away from my invention since my invention is designed to minimize particle-to-particle impact.

In other rotary driven comminution devices, comminution is achieved by impact but through the use of centrifugal force, as described in the following U.S. Patents.

In U.S. Pat. No. 4,090,673 by Ackers, et al., Ackers describes a vertical shaft mounted impeller table impact crusher which uses a plurality of breaker bars (referred to as stationary anvils by Ackers) mounted circumferentially around the impeller table. Ackers does not teach the use of clear-trajectory material path or the creation of a comminution environment within the apparatus which minimizes turbulence and particle-to-particle impact.

In U.S. Pat. No. 4,373,679 by Kawano, et al., Kawano, like Ackers, describes a vertical shaft mounted table impact crusher. However, Kawano, unlike my invention, relies on the material's impact with the blades on the rotor table, rather than a stationary breaker bar, to achieve shattering and comminution.

Rotary driven impact comminution has also been described with the use of a horizontal shaft and rotor in U.S. Pat. No. 4,151,959 by Deister. Deister teaches the use of a rotor with an essentially continuous blade angularly graduated or stepped along the rotor. The Deister rotor and invention encourages and promotes, in general, a turbulent environment wherein material is ricocheting off of the various interior walls of the housing striking other material in the process. Deister relies on the particle-to-particle impact to achieve comminution. Deister also teaches away from my invention in that Deister discourages the use of a round cross-sectional housing. As will be seen, my invention relies on a generally round cross-sectional housing to create a clear tangential material path trajectory to the sole breaker bar.

A dual-shaft rotary driven comminution machine has been tested by British Petroleum (the "BP Machine") and is somewhat described in a video film produced by British Petroleum. Although the internal design and workings of the BP Machine are not fully disclosed or described in the video film, the film indicates that the BP Machine intends to achieve comminution through the convergence of two centrifugal pump streams. In other words, the BP Machine relies on particle-to-particle impact to achieve comminution. In particular, the two centrifugal pump streams are, in part, created and directed at each other by the shape of the internal roof of the comminution chamber—a dual arched-shaped roof which serves to direct the two streams toward each other. The BP Machine thus teaches away from my invention in that my apparatus achieves comminution by attempting to minimize particle-to-particle impact and by specifically replacing the center portion of the dual-arched roof chamber of the BP Machine with a near-flat roof.

SUMMARY OF THE INVENTION

The dual-shaft rotary driven apparatus is comprised of a unique double-barrel shaped chamber with two counter-rotating shafts with a plurality of swingably mounted independent blades whereby, in operation, the blades lift the material from the two bellies of the chamber and fling the material, essentially without obstruction or other impact, to a single breaker bar. The breaker bar is mounted at the center and apex of the near-flat roof chamber and thus above the two shafts; and, the chamber shape is designed to allow for a clear and essentially tangential trajectory of the material as the material is flung from a blade by centrifugal force toward the breaker bar.

The chamber is shaped in the form of two slightly overlapping cylindrical barrels. However, the dual-arched shaped roof which would otherwise be formed by the overlap of such barrels is, in part, replaced with a near-flat roof. Thus, in vertical cross-section, the chamber is, in general, in the form of two slightly overlapping circles with their respective centers in the same horizontal plane. The dual arch formed at the top and bottom by the intersection of the circles is retained at the bottom of the chamber but not at the top of the chamber. In lieu of the dual-arch at the top and center of the chamber, the chamber is near-flat or somewhat elliptical in order to allow the needed clearance for the material's trajectory toward the breaker bar. No other breaker bars or other stationary impediments exist in the chamber in this clear trajectory path.

In cross-section, the shafts are viewed as axially mounted in the center of each such circle and thus the shafts are mounted in line with the barrel axes. The breaker bar is axially parallel to each shaft.

The chamber, referred to as the master chamber, can be axially divided into sub-chambers by walls or baffles with screens. Comminution proceeds in stages in the axial direction of the shaft. Although comminution can be achieved in the master chamber without partitioning the master chamber into sub-chambers, staged comminution using sub-chambers is the preferred embodiment of the invention.

Rock or other material is fed into the first sub-chamber, partially reduced in size and passed to the second sub-chamber through the screen. Material is comminuted in the second chamber to a smaller size and passed to the next chamber. The screens are generally mounted or inserted into the lower part of each wall or baffle and can be of varying hole size. A water stream can be injected into the first sub-chamber in order to assist in flowing the material from the first sub-chamber through the other sub-chambers to the exit sub-chamber. If the material is wet, there may be no need for an independent water source to move the material.

In general, the size of the particles allowed to move from stage to stage is regulated by the size of the screen holes. Also, the screens are located at a specified height above the bottom of the wall such that a pool of water forms in both barrel bellies of the comminution chamber.

DETAILED DESCRIPTION

Figure 1:
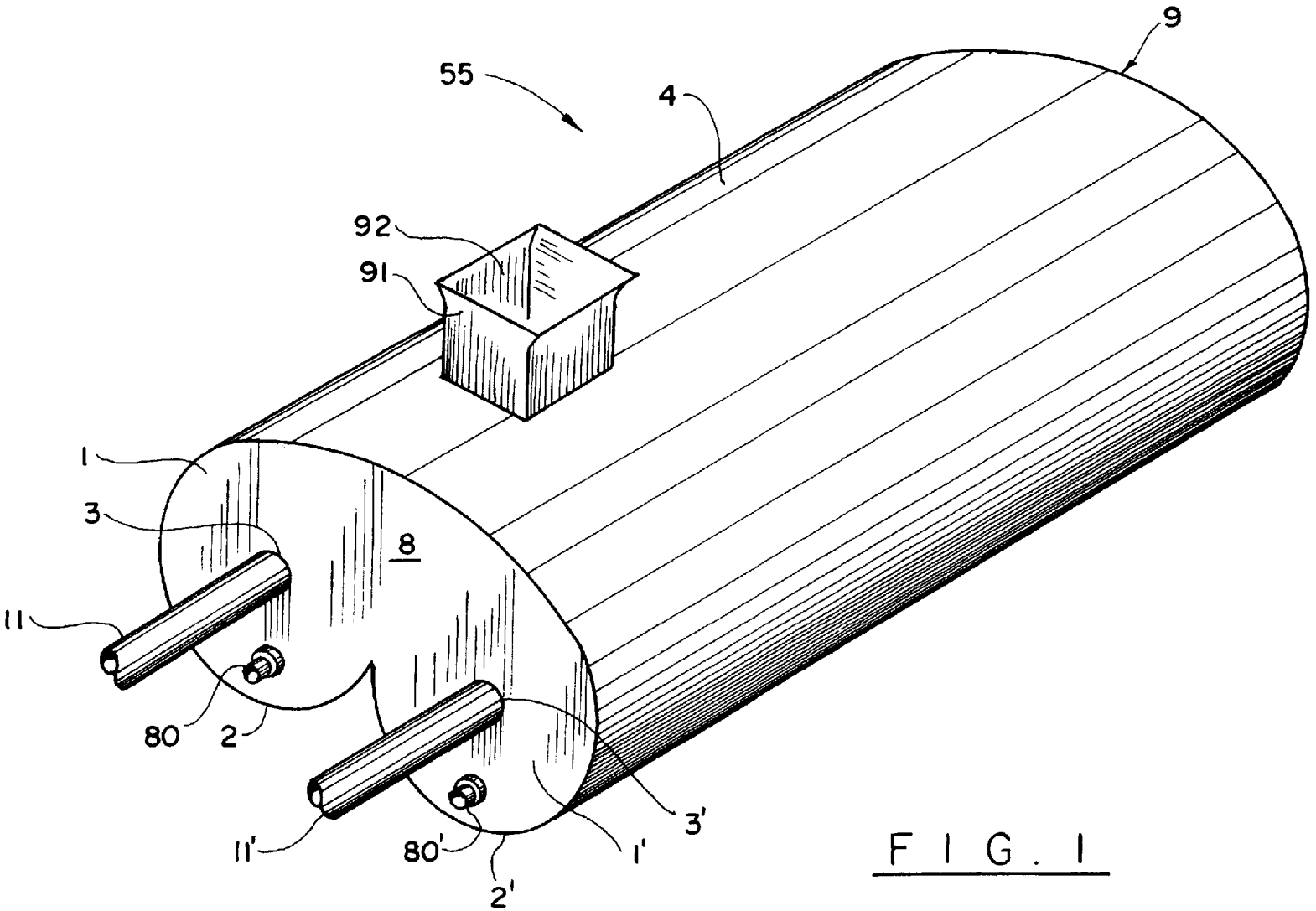
FIG. 1 is a pictorial view of a preferred embodiment of the present invention.

The dual-shaft rotary-driven comminuter of the present invention comprises a slightly overlapping double cylindrical barrel shaped master chamber 55 with a near-flat roof 44. The term "slightly overlapping" refers to the overlapping feature the barrels 1 and 1'. Rather than the barrels 1 and 1' being juxtaposed in a parallel manner (like a shotgun barrel or a pair of binoculars), the barrels 1 and 1', while parallel, are configured to sightly overlap and thus create a contiguous master chamber 55 which results from the removal of the overlapping barrel material. The barrels 1 and 1' have barrel bellies 2 and 2', respectively. The term "near-flat roof" refers to the substitution of the center section of the dual-arched roof, which dual-arched roof would otherwise be formed by the overlapping barrels 1 and 1', with an elliptical, low arch or near-flat roof.

The master chamber 55 contains two parallel and coplanar bearing mounted shafts 11 and 11', the axis of said shafts being the same as the axis of the cylindrical barrels 1 and 1' (sometimes also referred to as the "barrel axes"). In a preferred embodiment of the apparatus, the apparatus, in cross-section perpendicular to the axes of shafts 11 and 11', is as follows: (a) the master chamber 55 generally takes the form of two slightly overlapping circles 12 and 12' each of radius 13, which circles 12 and 12' define two vertices 15 and 16 at the intersections of circles 12 and 12'; (b) the axis of shaft 11 is located at the center of circle 12 and the axis of shaft 11' is located at the center of circle 12'; and, (c) a line 17 defined by the center of each circle 12 and 12' intersects circle 12 at a point 18 farthest from the vertices 15 and 16 and intersects circle 12' at a point 18' farthest from the vertices 15 and 16. The distance 14 between the axis of shafts 11 and 11' along line 17 is approximately equal to: $2 \times \cos 38° \times r$, where r is the radius 13. Radius 13 or r is sometimes hereinafter referred to as the barrel radius.

The master chamber 55 is split in the plane of the axes of shafts 11 and 11' into a top chamber 6 and a bottom chamber 7. In cross-section perpendicular to the axes of shafts 11 and 11', the vertex 15 defines a point of the bottom chamber 7; and, beginning at the vertex 15, the shape of bottom chamber 7 is formed by circumferentially moving away from vertex 15 simultaneously along circles 12 and 12' toward vertex 16, choosing the longest circumferential path to vertex 16, and ending at points 18 and 18', respectively.

In cross-section perpendicular to the axes of shafts 11 and 11', the points 18 and 18' define the respective ends of top chamber 6; and, beginning simultaneously at points 18 and 18', the shape of top chamber 6 is formed by circumferentially moving toward vertex 16 along circles 12 and 12', respectively, choosing the shortest circumferential path to vertex 16, such movement to be approximately 75° to point 19 on circle 12 and point 19' on circle 12'.

In cross-section perpendicular to the axes of shafts 11 and 11', a circular arc 20 joins points 19 and 19' to complete the shape of top chamber 6; and, the intersection 22 of a line 21 defined by the center of circle 12 and point 19 and a line 21' defined by the center of circle 12' and point 19' is the center of a circle which includes arc 20. However, in lieu of arc 20 a more elliptical or near-flat curve could also be used to join points 19 and 19' and thus complete the shape of top chamber 6. Whether the arc 20, the elliptical alternative or the near-flat alternative, such curve is hereinafter referred to as the near-flat roof 44 of the master chamber 55.

Walls 8 and 9, together with top chamber 6 and bottom chamber 7, basically form master chamber 55. The shafts 11 and 11' are journaled through holes 3 and 3', respectively, in wall 8, and 4 and 4', respectively, in wall 9. Prime mover rotating means 90, such as electric motors or combustion engines, coupled to suitable gear-boxes or belt systems, are coupled to shafts 11 and 11' such that shafts 11 and 11', in operation, counter-rotate. In operation, the direction of rotation for both shafts 11 and 11' is from vertex 16 to vertex 15 taking the shortest circumferential path from vertex 16 to vertex 15.

A material intake duct 91 is formed around an aperture 92 in the top of top chamber 6 to receive comminutable material. In a most preferred embodiment of the invention, the material intake duct 91 on the top of top chamber 6 is near wall 8, a rotating means 90 is coupled to shafts 11 and 11' near wall 8, and, hose type fittings 80 and 80' for use in injecting a stream of water into bottom chamber 7, and, in particular, barrel bellies 2 and 2', are mounted on wall 8. Screen interchangeable material outlet ports 5 and 5' are placed in wall 9 near the bottom of wall 9 and, when viewed in cross-section perpendicular to shafts 11 and 11', approximately directly below shafts 11 and 11', respectively. Thus, outlet ports 5 and 5' are aligned with the barrel bellies 2 and 2', respectively.

In an alternative embodiment of the invention, the rotating means 90 could be coupled to shafts 11 and 11' near wall 9 rather than wall 8.

In a most preferred embodiment of the invention, master chamber 55 is axially divided into three sub-chambers, 30, 31 and 32, by axially perpendicular walls or baffles 33 and 34, with shafts 11 and 11' journaled through such sub-chambers and baffles. The material intake duct 91 is located over sub-chamber 30 with sub-chamber 30 separated from sub-chamber 31 by wall or baffle 33 and sub-chamber 31 separated from sub-chamber 32 by wall or baffle 34. Within each sub-chamber 30, 31 and 32, at least one pair of blade-receivable sleeves 50 are mounted on shafts 11 and 11'. A pair of blades 60, in parallel, are swingably and independently attached to each sleeve 50 with a gap 62 between blades 60 to define a swinging dual-blade 71 such that, when shaft 11 or 11' is rotated at high speeds, the blades 60 become radially aligned with shaft 11 or 11', respectively. Blades 60 are independent in that each blade of the pair can swing independent of the other blade of the pair. These swinging and independent features of blade-to-sleeve coupling serve to enhance, in operation, the lifting and flinging of the comminutable material as well as reduce the risk of blade failure. For example, if one of the blades 60, in operation, encounters an obstacle (such as a large load of the material), the swingable feature assists in preventing said blade from shearing or otherwise failing as would a fixedly mounted blade.

A swinging dual-blade 72, identical to swinging dual-blade 71, is also mounted on each sleeve 50 at a location 180° from swinging dual-blade 71 such that, when shaft 11 or 11', respectively, is rotated at high speeds, the two blades of swinging dual blade 72 likewise become radially aligned with shaft 11 and serve to essentially centrifugally balance the radial load experienced by shaft 11 or 11', respectively, with that of swinging dual-blade 71. (In an alternative embodiment of the invention, three, rather than two, identical swinging dual-blades 71 are used on sleeve so in which case the spacing on sleeve 50 between dual-blades is 120° rather than 180° in order to achieve centrifugal balance.) The balanced pair of swinging dual-blades 71 and 72 on sleeve so is sometimes hereinafter referred to as rotary lifter 73 for shaft 11 and rotary lifter 73' for shaft 11'.

The distance 64 from the freely swinging ends 64 of the blades 60 to the axis of shaft 11 or 11' is slightly less than the radius 13 so that, in operation, the blades 60 do not strike or drag over master chamber 55.

The axial location of rotary lifter 73 on shaft 11 is, when compared with rotary lifter 73' on shaft 11', axially offset by a distance 74 such that, in operation, the blades 60 of rotary lifter 73 do not engage the blades 60 of rotary lifter 73'. Also, the distance 74 is sufficient to insure that comminutable material is not subjected to direct grinding between the blades of rotary lifter 73 and the blades of rotary lifter 73'. The arrangement of the pair of rotary lifters 73 and 73' relative to each other on the shafts 11 and 11' is said to be "complementary mounted." Multiple pairs of rotary lifters 73 and 73', each pair complementary mounted, can be located along the shafts 11 and 11' within each sub-chamber 30, 31 and 32 depending on overall throughput needs.

In a most preferred embodiment of the invention, three pairs of rotary lifters 73 and 73', each pair complementary mounted, are located on shafts 11 and 11' in each of chambers 30, 31 and 32 for a total of nine pairs of rotary lifters.

A single rectangular breaker bar 81 is attached to the interior and center of top chamber 6, which is also the apex of the near-flat roof 44. The breaker bar 81 extends from side wall 8 to side wall 9. In cross-section perpendicular to shafts 11 and 11', the long side 82 of rectangular breaker bar 81 is perpendicular to line 17 and the short side 83 of rectangular breaker bar 81 is parallel to line 17. The dimensions of sides 82 and 83 are set such that, in operation, the rotating blades 60 travel very close to, but do not strike, breaker bar 81. A clear-trajectory zone is established in the master chamber 55 in that no other breaker bar or stationary impediment exists within the master chamber. Thus, comminutable material can be flung by the rotary lifters 73 toward the breaker bar 81 in a clear-trajectory.

Screen receivable apertures 35 and 35' are located near the bottom of baffles 33 and 34 such that screen receivable apertures 35 are generally below shaft 11 and screen receivable apertures 35' are generally below shaft 11'. The screen receivable apertures 35 and 35' are thus generally in the barrel bellies 2 and 2' but are slightly raised above the floor of the barrel bellies 2 and 2' in order to allow water to pool in the barrel bellies, during operation, in each of the sub-chambers 30 and 31. Prior to operation, screens of desired hole size are inserted into the apertures 35 and 35' and 5 and 5', with the largest holes in the screens inserted in apertures 35 and 35' in baffle 33, smaller holes in the screens in apertures 35 and 35' located in baffle 34 and the smallest desired hole sizes located in the screens in apertures 5 and 5'.

In operation, comminutable material is fed into intake duct 91, is comminuted in stages through sub-chambers 30, 31 and 32 and eventually is flushed through the exit ports 5 and/or 5'. Selection of hole size for the screens regulates the comminution by allowing only material which has reached an acceptable level of comminution in one sub-chamber to travel to the next sub-chamber for further comminution.

The rotating means 90 rotates shafts 11 and 11' in counter-rotating fashion. The rotary lifters 73 and 73' scoop and lift the comminutable material from the barrel bellies 2 and 2', respectively, and fling said material toward the single breaker bar 81. I believe that the material is fractured when striking the longer side 82 of the breaker bar 81 and thereafter falls into the barrel bellies 2 and 2' for further comminution or, if reduced to the desired size, for flushing to the next sub-chamber or exiting the machine.

If the comminutable material is dry, water is injected into fittings 80 and 80' at a rate such that water pools in the barrel bellies 2 and 2', flows through the apertures 35 and 35' and toward the outlets 5 and 5'. The water serves both as a flushing function and as a means to cool the apparatus in operation.

Where the barrel radius 13 is approximately 7⅝ inches, I have discovered that about an inch of pooled water in the barrel bellies 2 and 2' is optimal. If the pool of water is less than an inch deep, the water does not achieve the desired level of flushing action. If the pool of water is deeper than an inch, I have found that it tends to stall the machine. Of course, if the comminutable material is wet, the amount of water which must be injected can be reduced. The water injection rate should be set, depending on the wetness of the comminutable material, so as to achieve the optimum pooling level for the given barrel radius.

The speed of rotation is dependent on the material to be comminuted and the barrel radius 13. The minimum fracture velocity is the speed at which the comminutable material must be traveling when it strikes a stationary object in order to fracture the material. Tables of such minimum fracture velocities are published and available to those skilled in the art. Thus, the rotation speed is set such that the blade tip speed of the pair of blades 60 is equal to or greater than the minimum fracture velocity for the given comminutable material.

Returning now to the purpose for the near-flat roof 44, I tested a version of my machine with the dual-arched top and found that it did not perform in a desirable manner. However, replacing the dual-arched top with the near-flat roof 44 and single breaker bar 81 produced the desired result.

I have also experimented with certain different blade configurations and have found the dual-parallel configuration of blade pair 60 to be preferable. In one case, I used four blades but, instead of the blades being in parallel pairs spaced at 180° intervals, I spaced the four blades at 90° intervals on the shaft sleeve, but alternated the sleeve side to which a blade was attached. Even though the sum total of the blade "lifting" or "shoveling" area was the same, the machine did not perform very well. Also, I tried using two blades spaced at 180° intervals wherein the sum total "lifting" area was equal to the four blades and again discovered that the machine performed poorly. I also tried a configuration with the parallel dual blades 60 but with a flat bar across the blades. The flat bar obviously significantly increased the "lifting" or "shoveling" area. I thought this would enhance the performance of the machine. Instead, somewhat to my surprise, I discovered that the machine did not perform very well at all.

The actual width of the blades used in my test machine, which has a barrel radius of 7⅝ inches, is approximately ¾"; and, the distance 62 between the blade pair 60 is approximately ¾".

While I have illustrated and described a preferred embodiment of my invention, it is understood that this is capable of modification, and I therefore do not wish to be limited to the precise details set forth, but desire to avail myself of such changes and alterations as fall within the purview of the following claims. Thus, it will be apparent to those skilled in the art that various changes in the structure and relative arrangement of the parts may be made without necessarily departing from the scope and spirit of my invention as defined in the claims.

I claim:

1. A comminution chamber comprising:

an overlapping double cylindrical barrel shaped housing wall structure forming a hollow chamber, for comminution therein, having a near-flat roof with an apex and a breaker bar coupled to said apex of an interior surface of said near-flat roof of said housing wall structure.

2. The comminution chamber of claim 1, wherein the slightly overlapping double cylindrical barrel shaped housing wall structure further comprises:

a bottom section having two barrel bellies;

a first barrel-end wall; and, a second barrel-end wall;

wherein said slightly overlapping double cylindrical barrel shaped housing wall structure defines two parallel and coplanar cylindrical barrel axes which intersect said first barrel-end wall and said second barrel-end wall and defines a breaker bar line along said apex of said near-flat roof wherein said breaker bar line is parallel to said barrel axes and said breaker bar is coupled along said breaker bar line.

3. The comminution chamber of claim 2, wherein said slightly overlapping double cylindrical barrel shaped housing wall structure accommodates a pair of shafts, each journaled through said housing wall structure along one of said barrel axes, respectively.

4. The comminution chamber of claim 3, wherein said pair of shafts accommodates a pair of rotary lifters, wherein each rotary lifter is comprised of a shaft sleeve with a centrifugally balanced plurality of swingably attached parallel pairs of independent blades, and wherein said pair of rotary lifters are complementary mounted on said pair of shafts.

5. The comminution chamber of claim 4, wherein said housing wall structure has a barrel radius of approximately 7⅝ inches and wherein each blade of said parallel pairs of independent blades has a width of approximately ¾ inch.

6. The comminution chamber of claim 4, wherein said housing wall structure further comprises a fitting mounted on said housing wall structure for injecting a fluid into said hollow chamber.

7. The comminution chamber of claim 4, wherein said housing wall structure is partitioned along said cylindrical barrel axes into a plurality of sub-chambers, including a beginning stage sub-chamber and a last stage sub-chamber, wherein the partitioning is achieved with a fitted baffle having apertures for regulating the size of said comminuted material which can pass between sub-chambers, and wherein a pair of rotary lifters are complementary mounted in each of said sub-chambers and wherein said last stage sub-chamber has an exit port.

8. The comminution chamber of claim 4, wherein said housing wall structure is partitioned along said cylindrical barrel axes into three sub-chambers and wherein three pairs of rotary lifters are complementary mounted in each of said three sub-chambers.

9. The comminution chamber of claim 4, wherein said housing wall structure is partitioned along said cylindrical barrel axes into three sub-chambers and wherein three pairs of rotary lifters are complementary mounted in each of said three sub-chambers.

10. The comminution chamber of claim 1, wherein said overlapping double cylindrical barrel shaped housing wall structure comprises a first barrel and a second barrel forming a hollow chamber shaped to allow for a clear trajectory of the comminutable material in each of said barrels of said overlapping double cylindrical barrel shaped housing wall structure from complementary mounted rotary lifters, by centrifugal force, toward said breaker bar coupled to said apex.

11. A comminution chamber comprising:

an overlapping double cylindrical barrel shaped housing wall structure forming a hollow chamber, for comminution therein, having first and second barrels, a near-flat roof with an apex and a breaker bar coupled to said apex of an interior surface of said near-flat roof of said housing wall structure wherein a clear-trajectory path is established in each of said barrels of said overlapping double cylindrical barrel shaped housing wall structure toward said breaker bar.

12. The comminution chamber of claim 11, wherein said slightly overlapping double cylindrical barrel shaped housing wall structure defines two parallel and coplanar cylindrical barrel axes and defines a breaker bar line along said apex of said near-flat roof wherein said breaker bar line is parallel to said barrel axes and said breaker bar is coupled along said breaker bar line.

13. The comminution chamber of claim 12, wherein said slightly overlapping double cylindrical barrel shaped housing wall structure accommodates a pair of shafts, each journaled through said housing wall structure along one of said barrel axes, respectively.

14. The comminution chamber of claim 13, wherein said pair of shafts accommodates a pair of rotary lifters, wherein each rotary lifter is comprised of a shaft sleeve with a centrifugally balanced plurality of swingably attached parallel pairs of independent blades, and wherein said pair of rotary lifters are complementary mounted on said pair of shafts.

15. The comminution chamber of claim 14, wherein said housing wall structure further comprises a fitting mounted on said housing wall structure for injecting a fluid into said hollow chamber.

16. The comminution chamber of claim 14, wherein said housing wall structure is partitioned along said cylindrical barrel axes into a plurality of sub-chambers, including a beginning stage sub-chamber and a last stage sub-chamber, wherein the partitioning is achieved with a fitted baffle having apertures for regulating the size of comminuted material which can pass between sub-chambers, wherein a pair of rotary lifters are complementary mounted in each of said sub-chambers and wherein said last stage sub-chamber has an exit port.

17. The comminution chamber of claim 11, wherein the overlapping double cylindrical barrel shaped housing wall structure comprises a first barrel and a second barrel forming a hollow chamber shaped to allow for a clear trajectory of the comminutable material in each of said barrels of said overlapping double cylindrical barrel shaped housing wall structure from complementary mounted rotary lifters, by centrifugal force, toward said breaker bar coupled to said apex.

18. A comminution chamber for comminuting comminutable material, said comminution chamber comprising:

a housing means for forming a hollow chamber, for comminution therein, wherein said housing means comprises a top member shaped near-flat having an apex and a bottom member having two slightly overlapping double cylindrical barrel bellies; and, a breaking means coupled to said apex of an interior surface of said top member wherein said housing means is shaped to allow for a clear trajectory zone in each of said slightly overlapping double cylindrical barrel bellies toward said breaking means.

19. The comminution chamber of claim 18, wherein said housing means is essentially devoid of other stationary impediments except said breaking means.

20. The comminution chamber of claim 18, wherein the housing means further comprises:

first and second barrel-end walls wherein said first and second barrel-end walls intersect two parallel and coplanar cylindrical barrel axes each at opposite ends of said housing means;

means for receiving comminutable material; and, means for exiting comminuted material.

21. The comminution chamber of claim 20, wherein said housing means accommodates two parallel shaft means for rotating, each journaled through said housing means along said barrel axes, respectively.

22. The comminution chamber of claim 21, wherein said two parallel shaft means accommodates a pair of rotary means for lifting and flinging, wherein each of the lifting and flinging rotary means is rotatably coupled to one of said two parallel shaft means for rotating in a complementary manner, and wherein each of said lifting and flinging rotary means comprises a plurality of centrifugally balanced swingably attached pairs of independent blades.

23. The comminution chamber of claim 22, wherein each blade of a pair of blades of said plurality of centrifugally balanced swingably attached pairs of blades are parallel and swing independent of the other, thereby enhancing lifting and flinging, as well as, reducing the risk of blade failure.

24. The comminution chamber of claim 22, wherein said housing means further comprises fluid inlet means for injecting a fluid into said hollow chamber.

25. The comminution chamber of claim 22, wherein said housing means further comprises a plurality of sub-chambers formed therein by a respective means for partitioning, and each said means for partitioning has disposed therein exiting means for regulating the size of comminuted material exiting to the next sub-chamber of said plurality of sub-chambers.

26. The comminution chamber of claim 25, wherein one of said lifting and flinging rotary means which is rotatably coupled to one of said two parallel shaft means for rotating is adjacent to and axially offset from another lifting and flinging rotary means which is rotatably coupled to the other of said two parallel shaft means for rotating thereby forming a rotary lifter pair; and wherein the rotary lifter pair is disposed in each of said sub-chambers.

27. A comminution chamber comprising:

a housing wall structure forming a hollow chamber, for comminution therein, having a low-arch roof with an apex wherein said housing wall structure is slightly overlapping double cylindrical barrel shaped; and, a breaker bar coupled to said apex of an interior surface of said low-arch roof.

28. The comminution chamber of claim 27, wherein said overlapping double cylindrical barrel shaped housing wall structure comprises a first barrel and a second barrel forming a hollow chamber shaped to allow for a clear trajectory of the comminutable material in each of said barrels of said overlapping double cylindrical barrel shaped housing wall structure from complementary mounted rotary lifters, by centrifugal force, toward said breaker bar coupled to said apex.

29. The comminution chamber of claim 27, wherein said slightly overlapping double cylindrical barrel shaped housing wall structure accommodates a pair of shafts, each journaled through said housing wall structure along a respective one of barrel axes.

30. The comminution chamber of claim 29, wherein said pair of shafts accommodates a pair of rotary lifters, wherein each rotary lifter is comprised of a shaft sleeve with a centrifugally balanced plurality of swingably attached parallel pairs of independent blades, and wherein said pair of rotary lifters are complementary mounted on said pair of shafts.

31. A comminution chamber comprising:

an overlapping double cylindrical barrel shaped housing wall structure forming a hollow chamber, for comminution therein, having a low-arch roof and a breaker bar coupled to an apex of an interior surface of said low-arch roof of said housing wall structure wherein said interior surface is devoid of other stationary impediments.

32. A comminution chamber for comminuting comminutable material, said comminution chamber comprising:

a housing wall structure forming a hollow chamber, for comminution therein, wherein said housing wall structure comprises first and second slightly overlapping double cylindrical barrels and a low-arch roof with an apex; and, a breaker bar coupled to said apex of an interior surface of said low-arch roof wherein said hollow chamber is shaped to allow for a clear and essentially tangential trajectory of the comminutable material in each of said slightly overlapping double cylindrical barrels from complementary mounted rotary lifters, by centrifugal force, toward said breaker bar.

* * * * *

UNITED STATES PATENT AND TRADEMARK OFFICE

CERTIFICATE OF CORRECTION

PATENT NO. : 5,887,809
DATED : March 30, 1999
INVENTOR(S) : Jerry Wayne Walters

Figure 2:
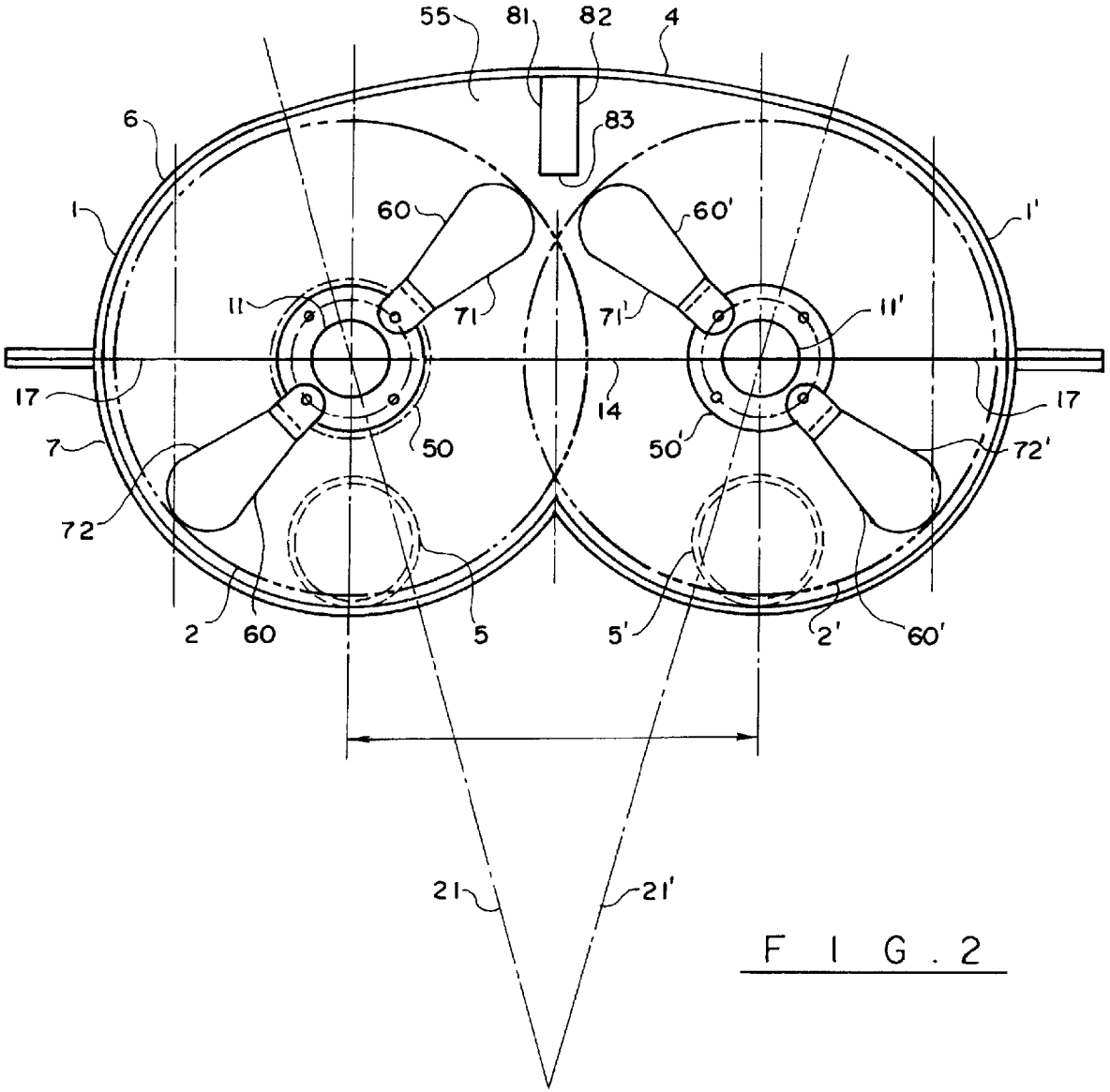
FIG. 2 is a vertical cross-sectional view showing the relative location of the shafts, breaker bar and blades within and the unique shape of the comminution chamber.
Figure 3:
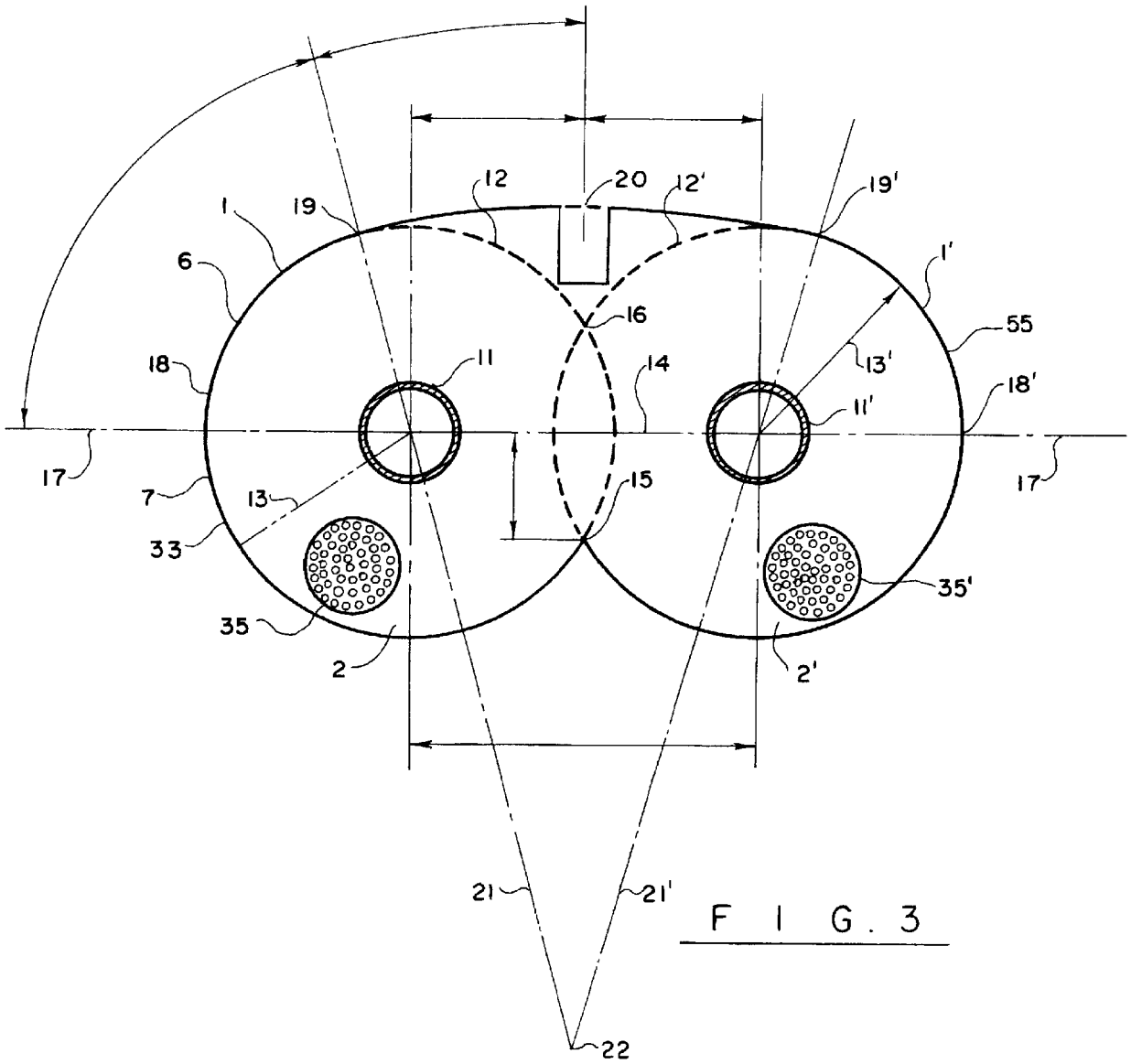
FIG. 3 shows a fitted vertical baffle for partitioning the comminution chamber into sub-chambers and it also shows the outline of the slightly overlapping barrels 1 and 1'.
Figure 4:
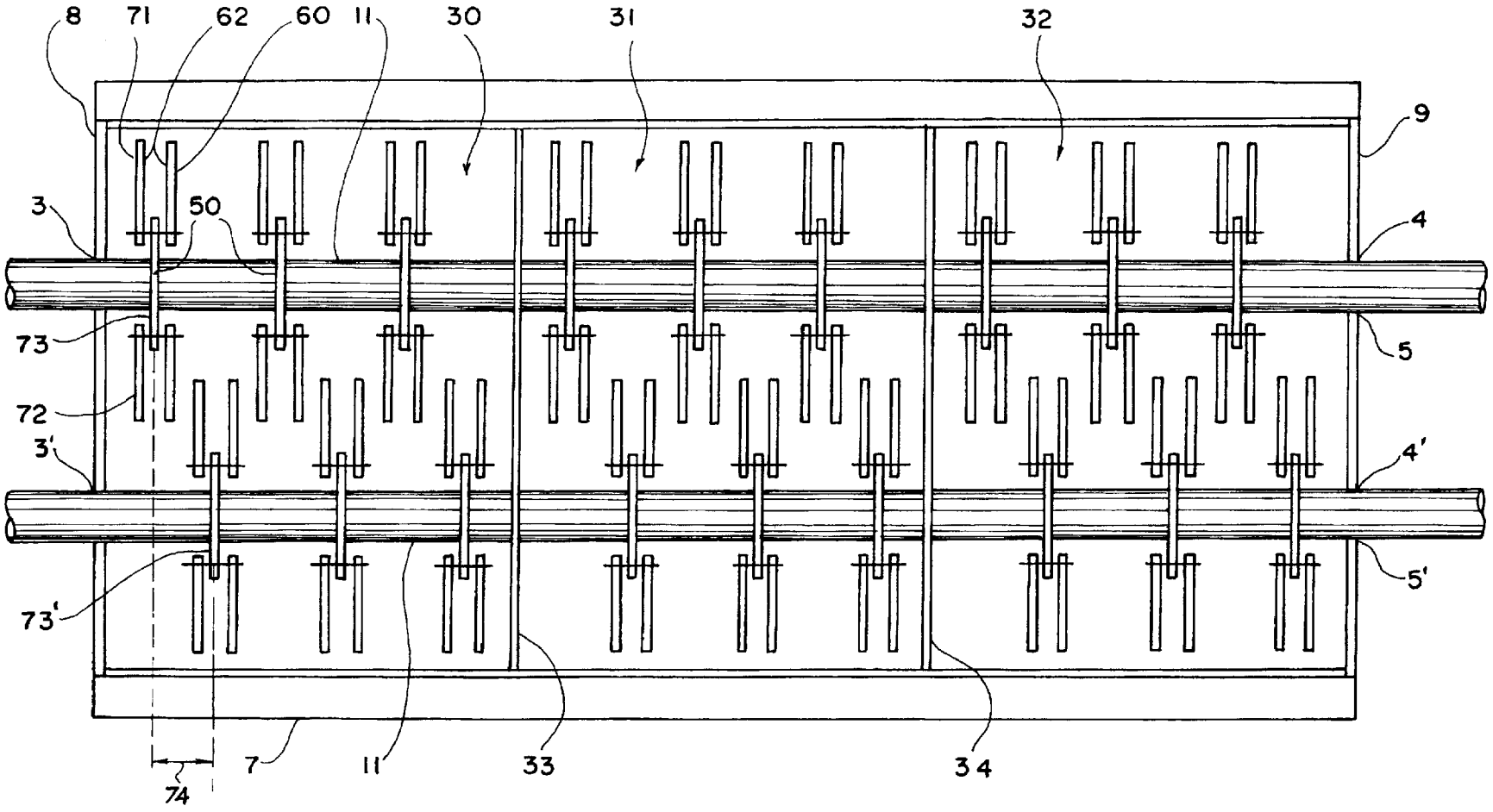
FIG. 4 is a view of the bottom part of the comminution chamber viewed from above and shows the dual shafts and location of the rotary lifters on the shafts and in the various sub-chambers.
Figure 5:
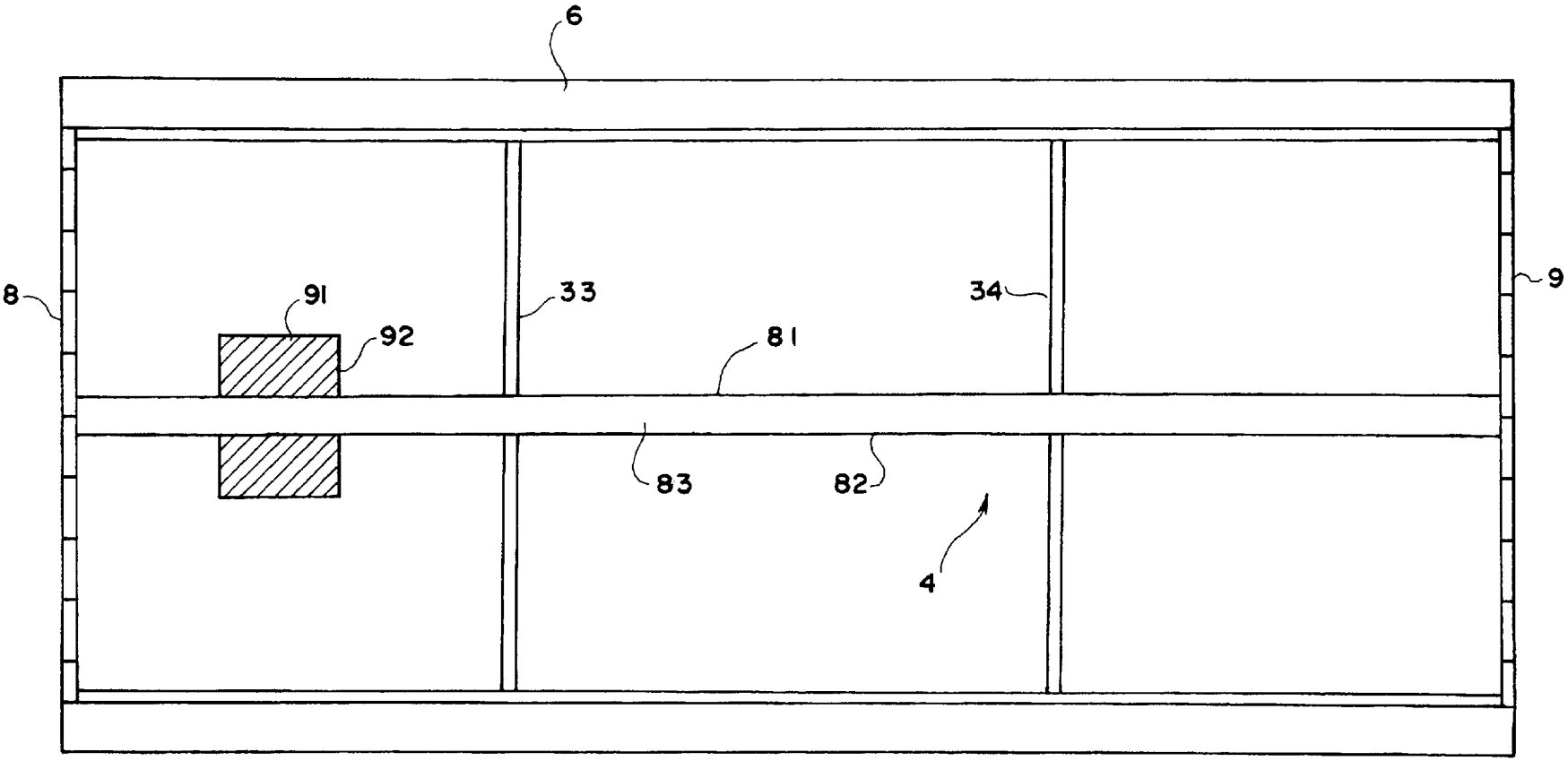
FIG. 5 is a view of the inside top part of the comminution chamber viewed looking up from the bottom of the comminution chamber.
Figure 6:
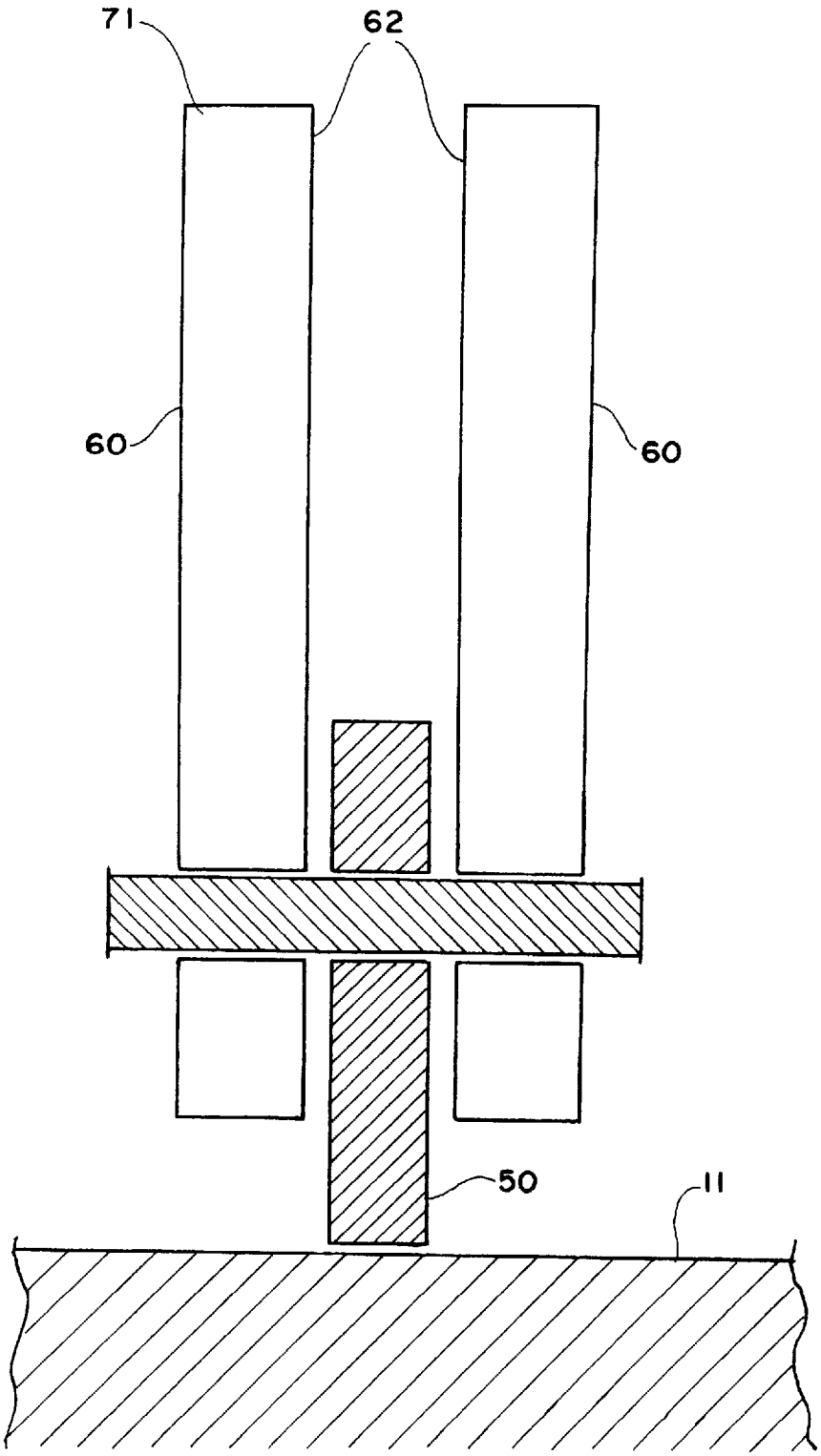
FIG. 6 is a view of a parallel pair of blades 60 mounted on a shaft sleeve 50.
Figure 7:
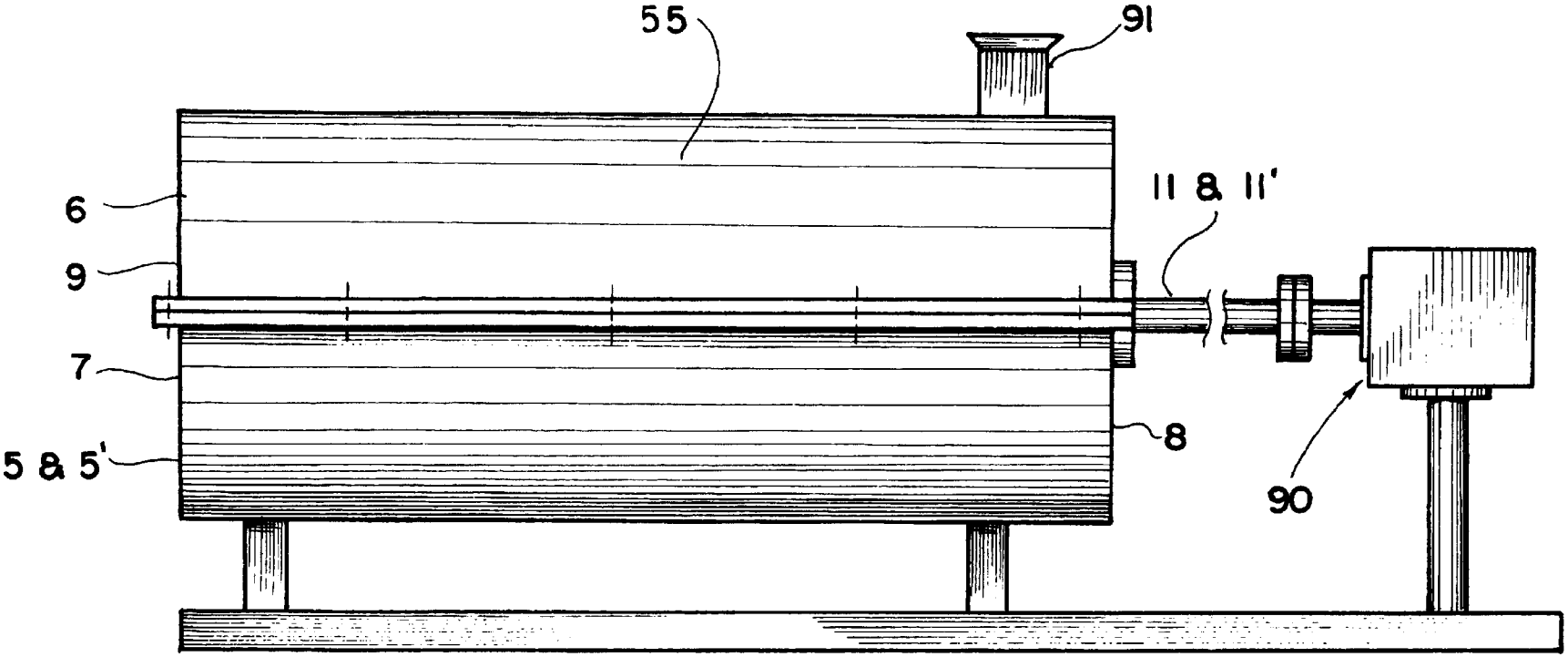
FIG. 7 shows the machine coupled to a prime mover.

It is certified that error appears in the above-identified patent and that said Letters Patent is hereby corrected as shown below:

In the drawings,
Sheet 1, Fig. 1, the reference numeral "4" should read -- 44 --.
Sheet 2, Fig. 2, the reference numeral "4" should read -- 44 --.
Sheet 3, Fig. 3, the reference numeral "18" should be pointing to intersection of barrel 1 and line 17.
Sheet 4, Fig. 4, the reference numeral "11", between reference numerals "7" and "33", should read -- 11' --.
Sheet 5, Fig. 5, the reference numeral "4" should read -- 44 --.

Column 3,
Line 59, "feature the" should read -- feature of the --.

Column 4,
Lines 10 and 11, "12 and 12' each of radius 13, which circles 12 and 12''' should read -- 12 and 12' of radius 13 and 13', respectively, which circles 12 and 12' --.

Column 5,
Line 46, "sleeve so in" should read -- sleeve 50 in --;
Lines 49 and 50, "sleeve so is" should read -- sleeve 50 is --;
Line 52, "The distance 64 from the freely swinging ends 64 of the" should read --The distance from the freely swinging ends of the --.

Column 8,
Line 43, "claim 4" should read -- claim 14 --.

Signed and Sealed this

Ninth Day of October, 2001

*Attest:*

Nicholas P. Godici

NICHOLAS P. GODICI
*Acting Director of the United States Patent and Trademark Office*

*Attesting Officer*